US008141486B2

(12) United States Patent
Faber

(10) Patent No.: US 8,141,486 B2
(45) Date of Patent: Mar. 27, 2012

(54) INK-STORAGE UNIT FOR HAND-OPERATED STAMP

(75) Inventor: Ernst Faber, Wels (AT)

(73) Assignee: Colop Stempelerzeugung Skopek Gesellschaft M.B.H. & Co. KG, Wels (AT)

( * ) Notice: Subject to any disclaimer, the term of this patent is extended or adjusted under 35 U.S.C. 154(b) by 461 days.

(21) Appl. No.: 12/311,417

(22) PCT Filed: Oct. 2, 2007

(86) PCT No.: PCT/AT2007/000463
§ 371 (c)(1),
(2), (4) Date: Mar. 27, 2009

(87) PCT Pub. No.: WO2008/043116
PCT Pub. Date: Apr. 17, 2008

(65) Prior Publication Data

US 2010/0031835 A1 Feb. 11, 2010

(30) Foreign Application Priority Data

Oct. 11, 2006 (AT) ..... GM 741/2006

(51) Int. Cl.
*B41K 1/38* (2006.01)
*B41K 1/52* (2006.01)
*B41K 1/54* (2006.01)

(52) U.S. Cl. ..... 101/327; 101/333

(58) Field of Classification Search ..... 101/327, 101/333, 334, 405, 406
See application file for complete search history.

(56) References Cited

U.S. PATENT DOCUMENTS

| | | | | |
|---|---|---|---|---|
| 1,463,718 | A | 7/1923 | Munson | |
| 3,832,947 | A * | 9/1974 | Funahashi | 101/327 |
| 5,462,595 | A | 10/1995 | Im | |
| 5,505,130 | A | 4/1996 | Winston | |
| 5,855,170 | A | 1/1999 | Shih | |
| 5,865,305 | A | 2/1999 | Yasoshima | |
| 6,047,639 | A * | 4/2000 | Shih | 101/333 |
| 6,189,450 | B1 * | 2/2001 | Shih | 101/327 |
| 6,302,022 | B1 * | 10/2001 | Shih | 101/379 |
| 6,526,882 | B1 * | 3/2003 | Shih | 101/327 |
| 6,834,584 | B1 * | 12/2004 | MacNeil | 101/333 |
| 7,069,852 | B2 | 7/2006 | Zindl et al. | |
| 2004/0168590 | A1 | 9/2004 | Petersen | |
| 2006/0144267 | A1 | 7/2006 | Moody | |

FOREIGN PATENT DOCUMENTS

| | | |
|---|---|---|
| JP | 2000-127588 | 5/2000 |
| WO | WO 03/099572 | 12/2003 |

OTHER PUBLICATIONS

International Search Report for PCT/AT2007/000463 dated Feb. 11, 2008.

* cited by examiner

*Primary Examiner* — Leslie J Evanisko
(74) *Attorney, Agent, or Firm* — Collard & Roe, P.C.

(57) ABSTRACT

An ink-storage unit (1) for a hand-operated stamp, comprising a trough-shaped container (2) which is open at the top and inside of which an ink-storage body (3) is arranged, the latter being configured to deliver stamping ink (13) to a printing plate in the operating state, wherein at least an attachment frame (5A) is associated with the container (2), the attachment frame being detachably fixable, or fixed, to the upper side of the container (2) to serve as a filling aid.

9 Claims, 7 Drawing Sheets

INK-STORAGE UNIT FOR HAND-OPERATED STAMP

CROSS REFERENCE TO RELATED APPLICATIONS

This application is the National Stage of PCT/AT2007/000463 filed on Oct. 2, 2007, which claims priority under 35 U.S.C. §119 of Austrian Application No. GM 741/2006 filed on Oct. 11, 2006. The international application under PCT article 21(2) was not published in English.

BACKGROUND OF THE INVENTION

The invention relates to an ink-storage unit for a hand-operated stamp, comprising a trough-shaped container which is open at the top and inside of which an ink-storage body is arranged, the latter being configured to deliver stamping ink to a printing plate in the operating state.

Hand-operated stamps which are provided with an ink-storage unit as indicated above are usually called pre-inked stamps. The stamping ink necessary for creating the stamp imprint is stored in the ink-storage body which transfers the stamping ink to the printing plate adjoining the same. The ink-storage body may be based on different techniques, e.g. on a salt washing out method, on a gel system, on a foam (vinyl foam) system (PVA), or on a fiber-body system (PE).

In case of an open-pored foam material, e.g. EVA (ethylene vinyl acetate), and PE (polyethylene), with a more innovative method, the so-called flash system, a closing of pores of the open-pored material is caused in those regions where no stamp imprint shall be created, so as to obtain a distinct printing plate, namely by means of short exposure (flash), in particular by the aid of xenon lamps. However, in those regions where a stamp imprint shall be created, the pores of the printing plate remain open. To apply the desired image for the stamp imprint to the stamp-plate blank, pre-cut EVA plates are put into an exposure apparatus, along with a foil including the desired stamp-imprint image which has been produced by the aid of a computer, e.g. the printing plate is then produced by employing flash-like exposure once or several times.

For operation, this EVA or PE printing plate shall be provided with stamping ink for which purpose the ink-storage body is used which is soaked with stamping ink and consists particularly of PVA foam material. Such ink-storage bodies are usually offered in bag packages in a tub-shaped, or trough-shaped, container which is open at the top. Before inserting the storage body with its container into the respective hand-operated stamp, e.g. the user soaks the stamp with stamping ink, it being difficult to provide the storage body with the right amount of stamping ink. This soaking with the right amount of stamping ink would be much easier during production but this, in turn, would cause problems when removing the ink-storage unit which consists of container and ink-storage body out from the respective packaging and when inserting the same into the hand-operated stamp since this usually involves soiling. Already when cutting open the packaging, the cutting means, e.g. a pair of scissors, may contact the stamping ink, and a similar soiling is virtually inevitable when removing the inked pad material (made of PVA or PE) from the packaging before fixing the printing plate and inserting the unit into the stamp casing.

SUMMARY OF THE INVENTION

It is now an object of the invention to overcome this disadvantage and to provide for an ink-storage unit of the initially-defined kind by means of which soaking of the ink-storage body with the right amount of stamping ink becomes possible in a simple manner so as to allow for a filling only after removing the packaging so that the above mentioned disadvantageous soiling when removing the ink-storage unit from the packaging, and when inserting the same into a hand-operated stamp may be avoided.

To achieve this object, the invention provides for an ink-storage unit for a hand-operated stamp, comprising a trough-shaped container which is open at the top and inside of which an ink-storage body is arranged, the latter being configured to deliver stamping ink to a printing plate in the operating state. There is an attachment frame associated with the container. The attachment frame is detachably fixable, or fixed, to the upper side of the container to serve as a filling aid.

According to the invention, an attachment frame is associated with the container which contains the ink-storage body, said attachment frame being detachably fixed, or fixable, to the open upper side of the container. This attachment frame may serve as a filling aid, i.e. as a "dosing frame", when soaking the ink-storage body with stamping ink. For example, this filling frame may be of such a height that, relative to the base area of the frame, exactly the right filling level of stamping ink will be received in the filling frame which will then gradually penetrate into the storage body and soak the same.

To detachably fix the filling frame to the container, the filling frame and the container, and/or the walls of the container, may include cooperating snap-on fixing elements, e.g. detents and undercuts, wherein the filling frame, with detents, advantageously engages over lateral projections of the container's rim at least two opposing sites and snaps in therebehind. In particular, it is advantageous and sufficient if simply snap-on fixing elements are provided on the longitudinal sides of the container, and/or the filling frame, which is rectangular in top view. Nevertheless, mention shall be made here that also a circular container, with a circular attachment, is principally possible, e.g. in case of circular stamps, with the snap-on fixing elements then advantageously being provided at sites diametrically opposing each other.

To avoid leaking of the stamping ink from the container, it is beneficial if the attachment frame contacts the walls of the container on all sides, and at least partially overlaps the same.

Furthermore, it is also advantageous if the attachment frame adjoins the ink-storage body with a lower ring-like closed flange projection so as to obtain a sort of additional sealing in the region where the attachment frame adjoins the ink-storage body during filling. Advantageously, this flange projection extends in parallel to the upper rim of the container of the ink-storage unit.

It is also possible to associate an attachment lid with the container, which includes the ink-storage body, in addition to the attachment frame which serves as a filling aid and is shortly called (dosing) frame hereinafter; in this case, either the lid or the frame may be put onto the container, as need be.

Mention shall be made here that it is known per se to attach a lid to an ink-pad container, e.g. in a pivotable manner; compare, for example, U.S. Pat. No. 1,463,718 A, U.S. Pat. No. 5,505,130 A, U.S. Pat. No. 5,865,305 A or JP 2000-127 588 A. Yet, these documents relate to usual ink-pad containers for supplying ink at the hand-operated stamp, and not to ink-storage units with ink-storage body and printing plate to be inserted into pre-inked stamps in case of which filling of the ink-stamp body is quite difficult in respect of measuring the volume of the stamping ink. Also the ink pad of U.S. Pat. No. 5,462,595 A has the mentioned usual construction and function; also here, a pivotable lid is attached to the ink-pad container; furthermore, a separate pivotable ink container is fixedly connected to the ink-pad container so as to provide ink to the same in a pivoted-up position.

BRIEF DESCRIPTION OF THE DRAWINGS

In the following, the invention will be explained in even more detail by way of particularly preferred exemplary embodiments, yet without being restricted thereto. In detail.

DETAILED DESCRIPTION OF THE PREFERRED EMBODIMENTS

Figure 1:
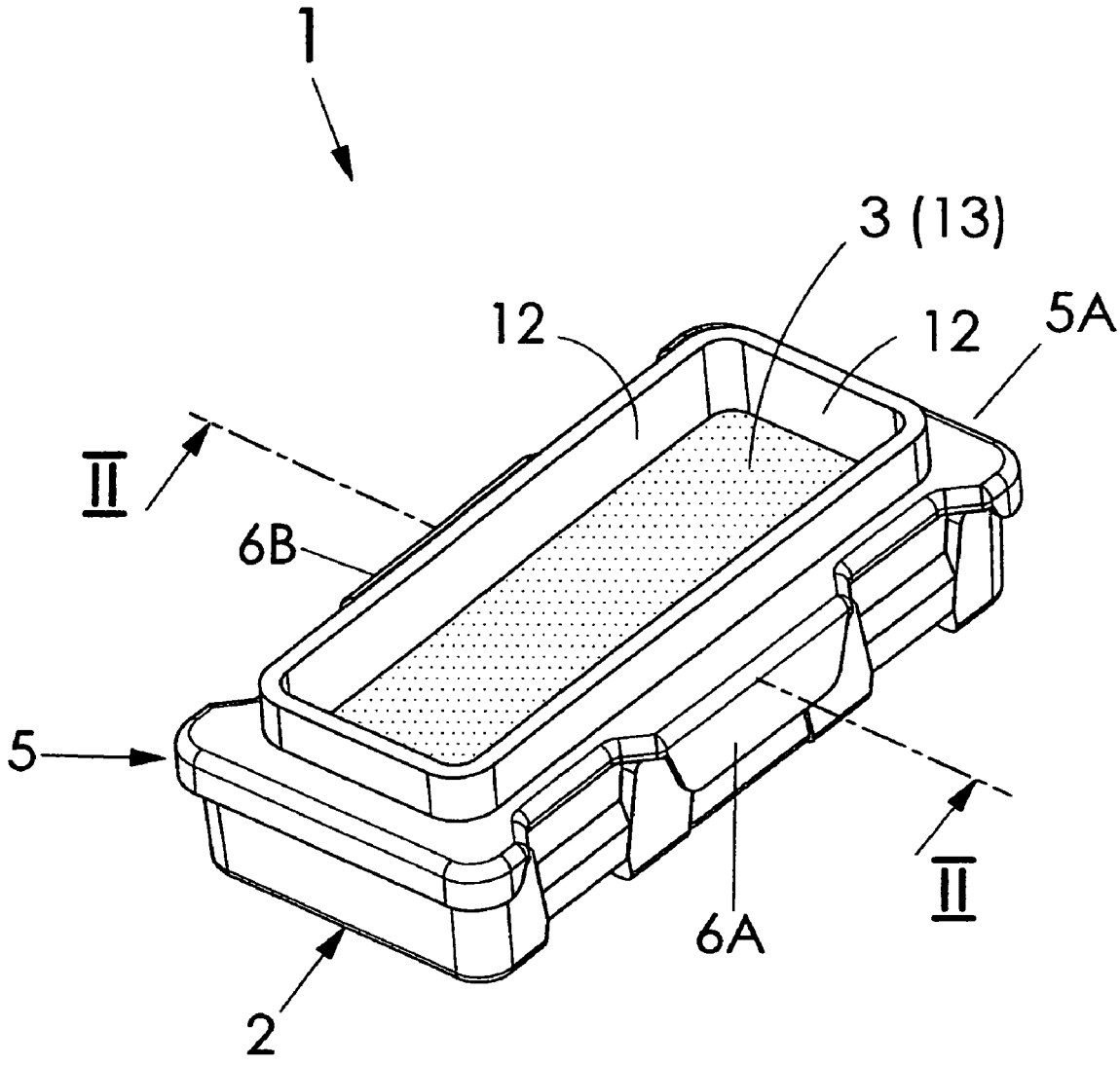
FIG. 1 shows a view onto a container which includes an ink-storage body and a filling frame attached thereto.
Figure 2:
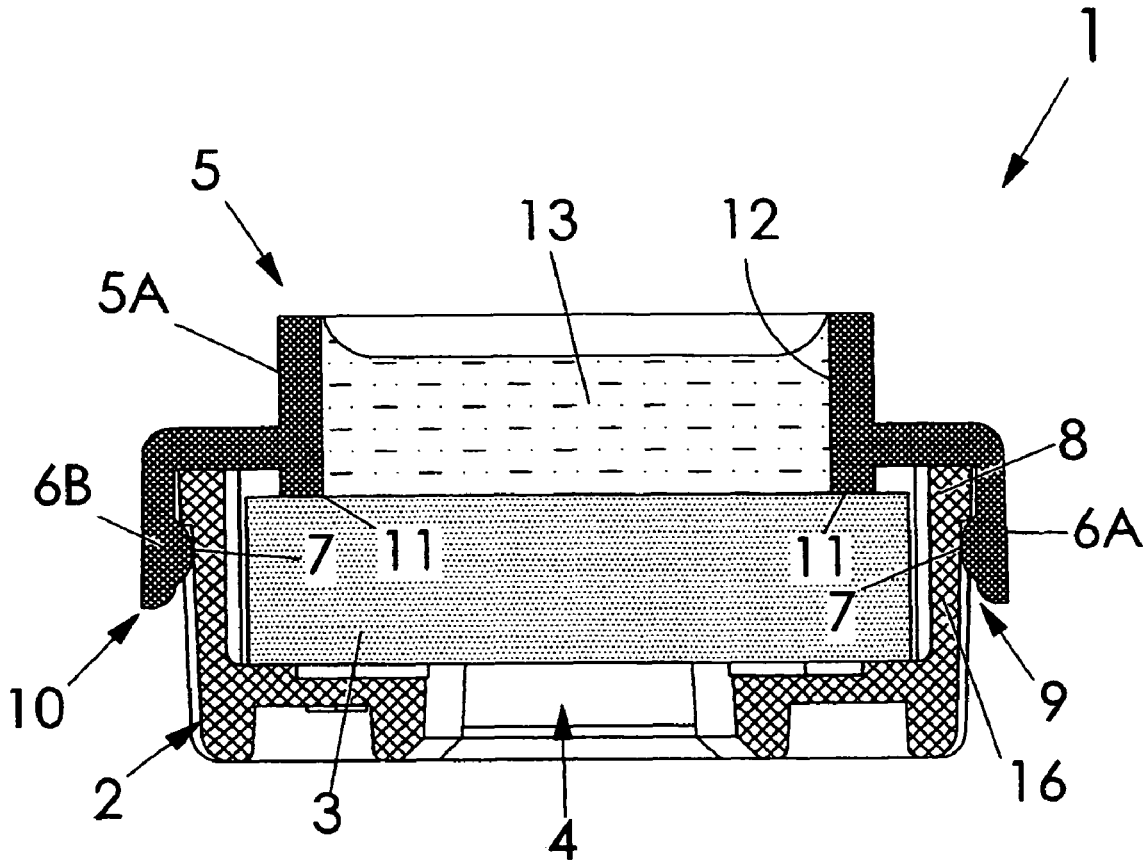
FIG. 2 shows a cross-section through this ink-storage unit along line II-II of FIG. 1.
Figure 3:
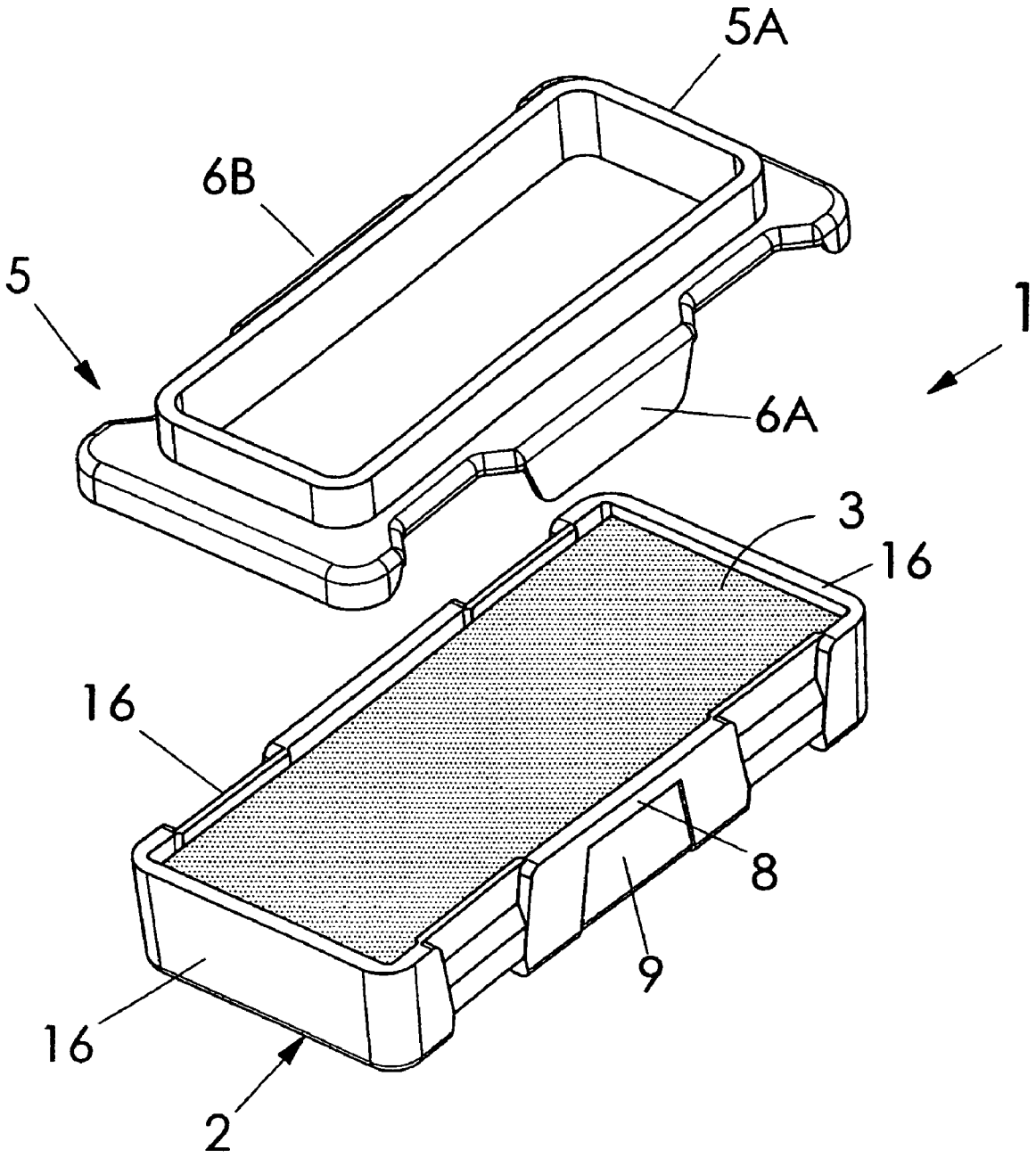
FIG. 3 shows a chart of the container plus storage body, with the filing frame being detached.

FIGS. 1 to 3 show an ink-storage unit 1 for a hand-operated stamp (not illustrated), including a container 2 which, in top view, is generally rectangular, is tub-shaped, or trough-shaped, and is open at the top. The container 2 receives an ink-storage body 3 of rectangular or cuboidal design. Above the ink-storage body 3, the container 2 provides further space for a printing plate (stamping plate) of the so-called flash type (not illustrated in the drawing), as discussed initially. The lower side of the container 2 has an opening 4 for later refilling to soak the ink-storage body 3 after the hand-operated stamp which includes the ink-storage unit 1 has been put into operation.

The container 2 is provided with an attachment 5 in the form of an attachment frame 5A which, corresponding to the form of the container 2, rectangular in top view, is likewise generally rectangular and has snap-in hooks 6A, 6B, on either longitudinal side, each of which, when pushing the attachment frame 5A onto the container 2, snap, with its rounded projections 7 into a detent recess 9 defined below an outwards-projecting ledge 8, compare FIG. 3 to FIGS. 1 and 2. Thus, the snap-in hooks 6A, 6B form snap-on fixing elements 10 with its projections 7, on the one hand, and the ledge-shaped projections 8 of the container with the detent recesses 9 defined below, on the other hand, compare FIG. 2. It goes without saying that a different embodiment of the snap-on fixing elements 10 is also conceivable, e.g. snap-on fixing elements 10 that extend across the entire length of both longitudinal sides of the container 2 and the attachment frame 5A. Moreover, it would be theoretically also possible to provide appropriate snap-on fixing elements on either broad side (as well). Furthermore, it is certainly also possible to provide detent recesses on the attachment frame 5A, and snap-in projections, similar to the rounded projections 11, at the walls of the container.

As can be seen particularly in FIG. 2, a lower circumferential flange projection 11 is provided inside the attachment frame 5A, the former adjoining the upper side of the ink-storage body 3 in the snapped-on position of the attachment frame 5A. The inner wall 12 of the frame 5A is provided at each of the four sides of the frame 5A in a continuous manner, and it defines a "dosing container" for stamping ink 13 (cf. FIG. 2) which is filled into the interior of the frame 5A by means of a bottle-type plastics container 14 (cf. FIG. 4), e.g. Here, the frame 5A is filled up to the upper rim, and, due to selected height of the frame 5A, this filling level corresponds exactly to the amount of ink the ink-storage body 3 can receive. The stamping ink 13 gradually penetrates into the ink-storage body 3 which is designed, e.g. as an open-pored foam body or as a fiber-material body (made of PE material) until the ink-storage body 3 is completely soaked with stamping ink 13. This complete soaking of the ink-storage body 3 is shown in FIG. 1 in a schematic representation—compared to FIG. 3—by a few dots.

Figure 4:
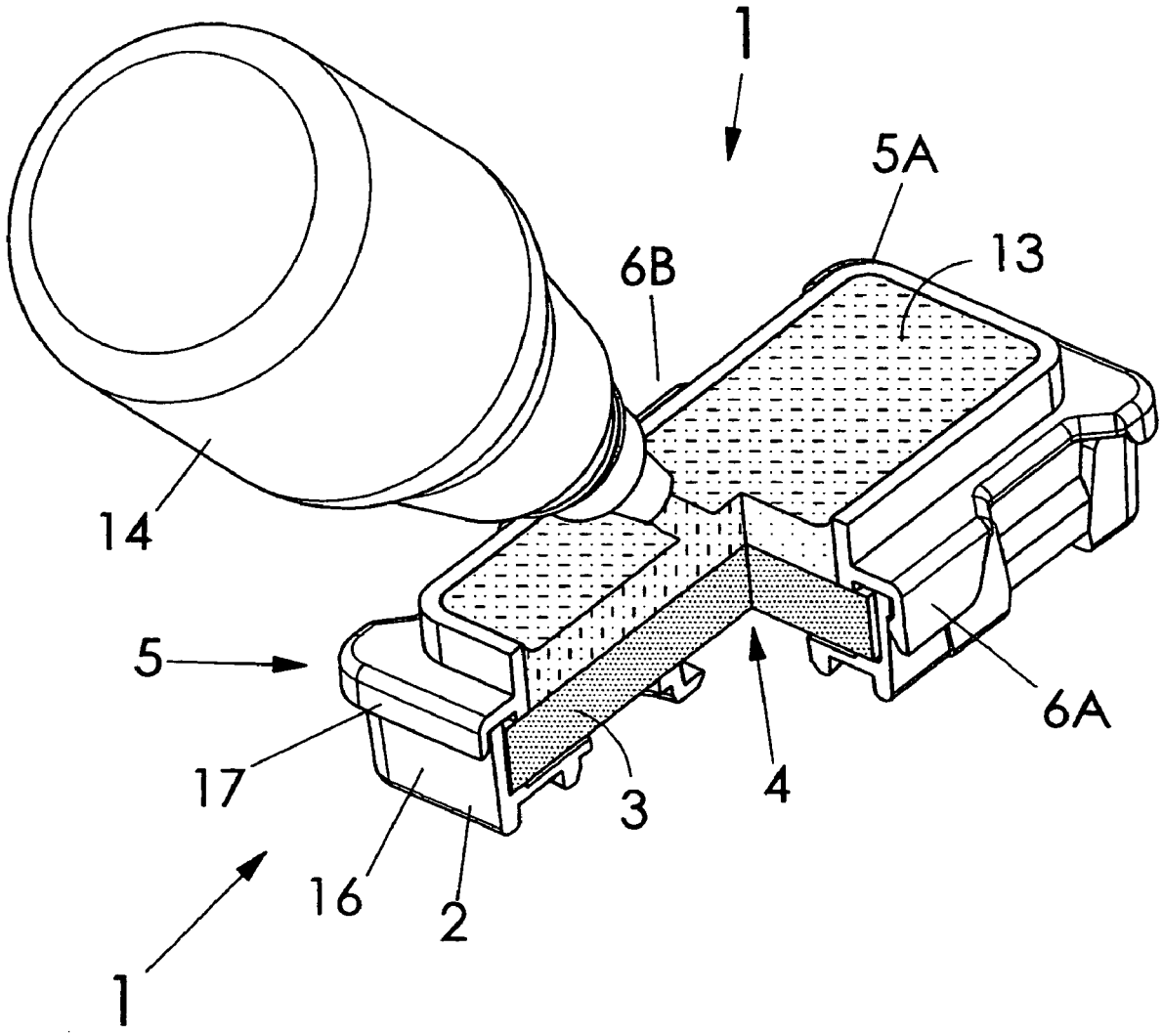
FIG. 4 shows the filling of a container for soaking the contained ink-storage body using the filling frame of FIGS. 1 to 3, in a schematic, partially cutaway view.
Figure 5:
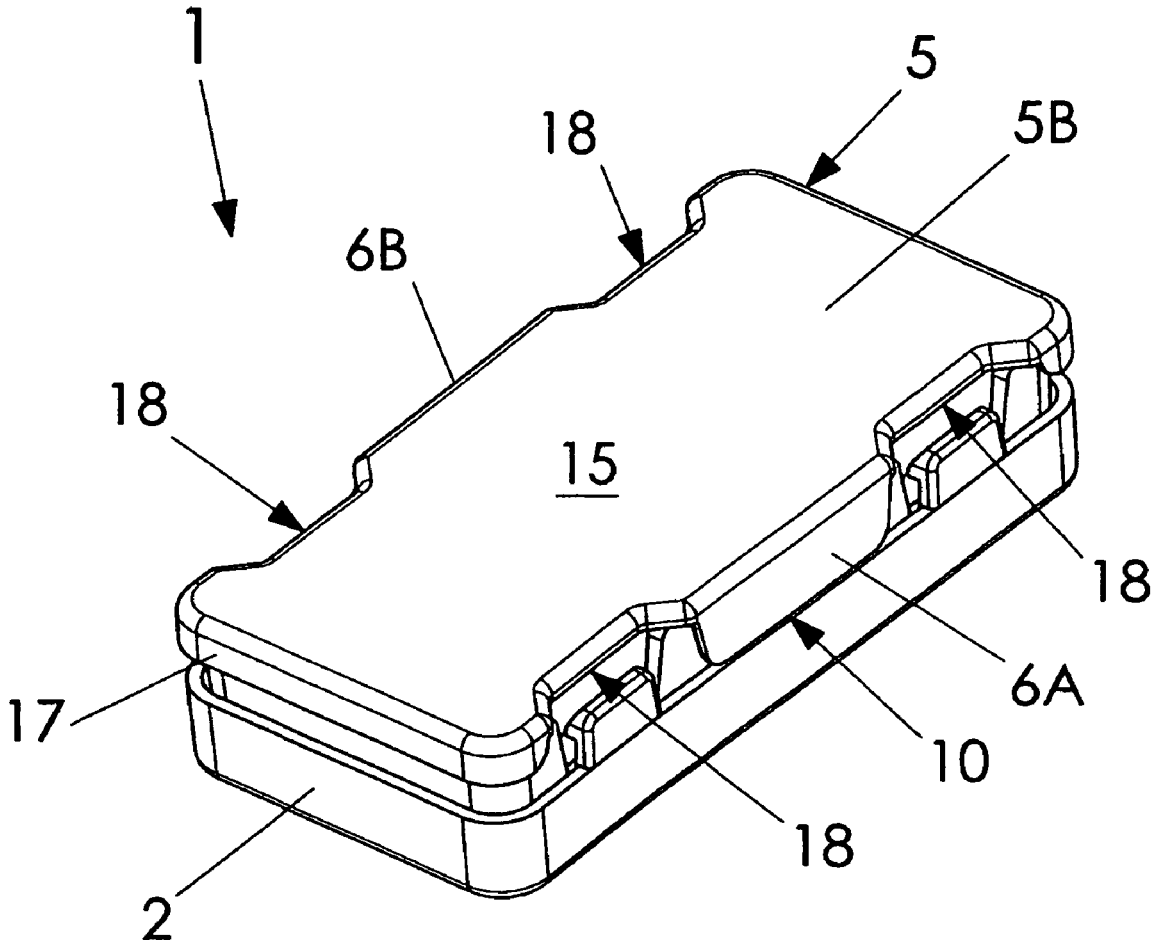
FIG. 5 likewise shows a view similar to FIG. 1 onto a container with a closing lid provided in the form of a cap.

After filling and soaking the ink-storage body 3 with stamping ink 13, as just described and as can be seen from FIGS. 2, 4 and 1, the attachment frame 5A is detached from the container 2. Thereafter, depending on whether the ink-storage unit 1 has been filled by the producer, or by the user, of the hand-operated stamp, the container may be closed by means of a different attachment in the form of a lid 5B (cf. FIG. 5), or the ink-storage unit 1 may be inserted directly into the hand-operated stamp (not illustrated in further detail) without the attachment 5 so as to allow for usual use thereof. In this case, the flash-type printing plate (not illustrated) has certainly also to be attached to the upper side of the storage body 3 in the container 2 beforehand.

Similar to the filling frame 5A, the lid-attachment 5B (shortly also called lid 5B hereinafter) has snap-in hooks 6A, 6B which snap in detent recesses 9 (not further illustrated n FIG. 5) below an outwards-projecting ledge 8 (see FIG. 2) when the lid 5B is being put onto the container 2. To close the container 2, the lid 5B has a top wall 15 which rests closely on the upper rims of the container walls 16 so as to achieve a sealing of the container 2 as tight as possible to prevent the stamping ink 13 from leaking in case of an already soaked ink-storage body 3, thus preventing the environment of the ink-storage unit 1, e.g. a packaging or the fingers when removing the ink-storage unit 1 from a packaging, from being soiled. After a flash-type printing plate has been attached in the container 2 above the ink-storage container 3, the lid 5B can be inserted into the respective hand-operated stamp.

Figure 6:
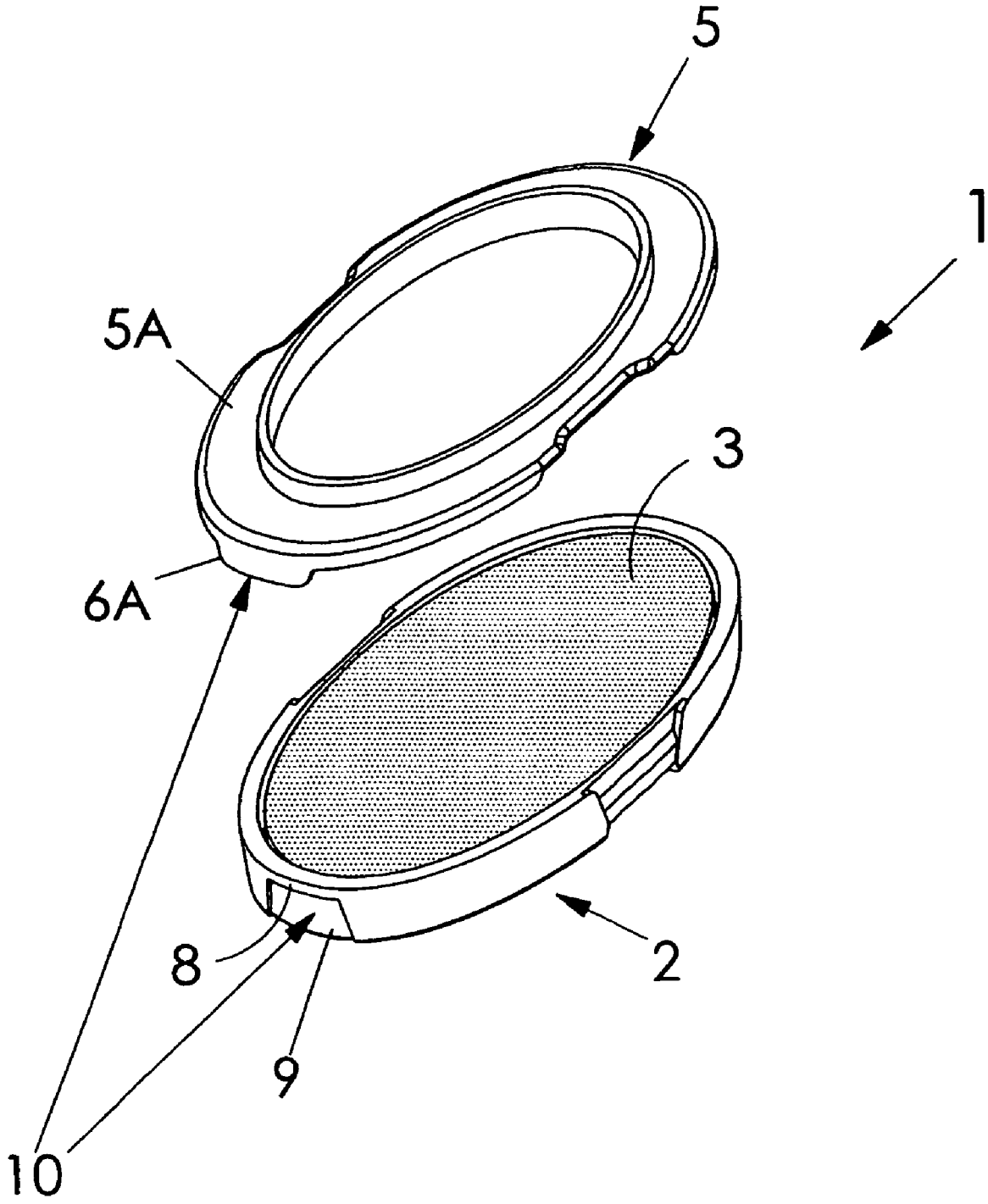
FIGS. 6 and 7 are exploded views, similar to FIG. 3, of two further embodiments of the inventive ink-storage unit.
Figure 7:
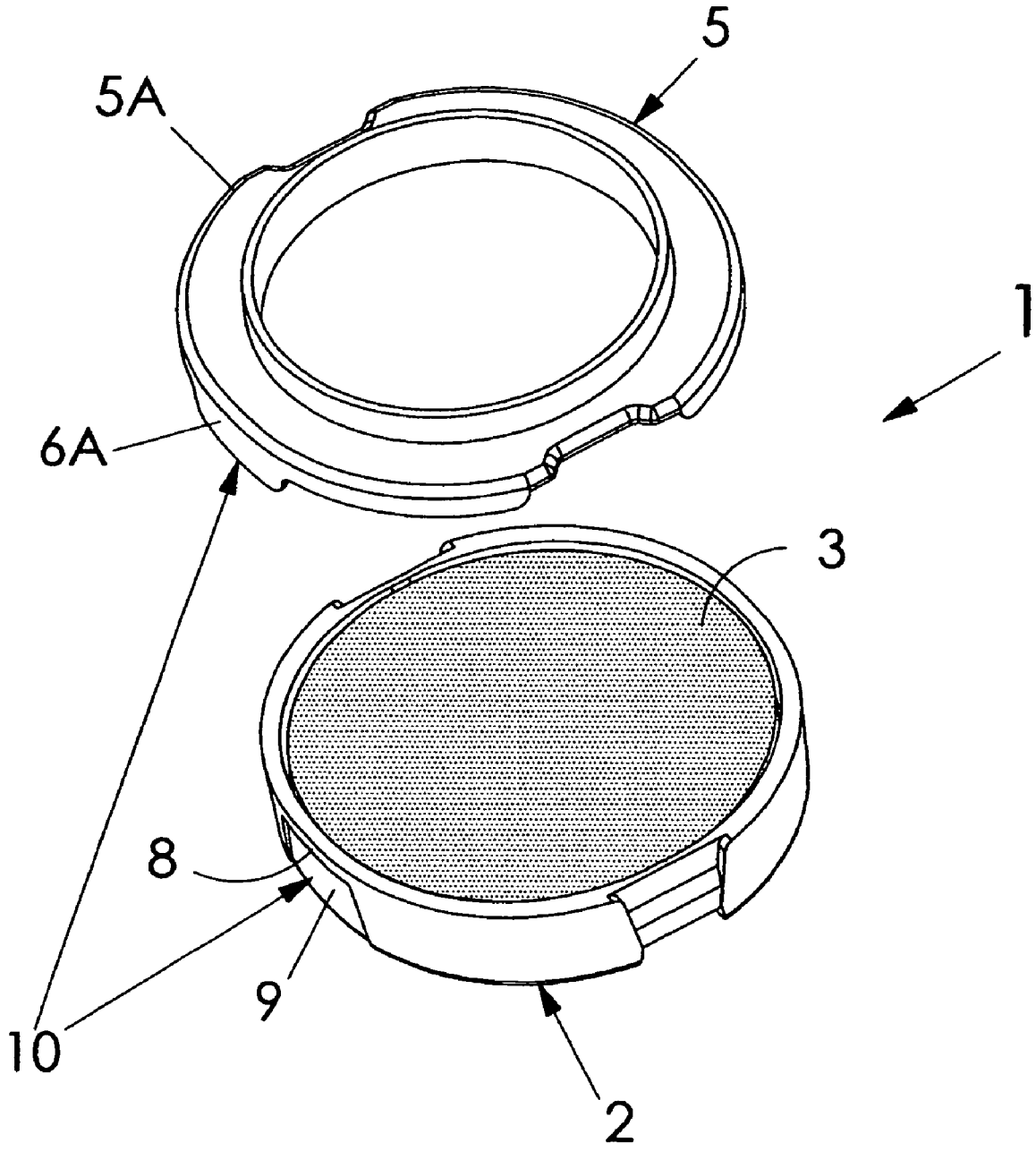

Although the invention has been explained above by way of a particularly preferred exemplary embodiment, variations and modifications within the scope of the invention are certainly possible, e.g. in the shape of the ink-storage unit 1. Instead of being generally rectangular in top view as shown in FIGS. 1 to 5, this design could also be squarish, oval or circular, compare FIGS. 6 and 7 which show an oval (FIG. 6) and circular (FIG. 7) embodiment of the container 2, which includes the ink-storage body 3, as well as of the filling frame 5A. Here, the snap-on fixing elements 10 may be provided with the projecting rim ledges 8, and the snap-in hooks, e.g. 6A, may be arranged at two diametrically opposing sites.

Furthermore, it is conceivable to design the filling frame 5A of FIGS. 1 to 4 to be a little bit higher, and to mark the filling level for filling the stamping ink from the container 14 by means of a (possibly circumferential) line (not illustrated) on the inner wall 12 so that the frame 5A is to be filled with stamping ink 13 up to this line only and not up to the upper rim. Depending on the type of hand-operated stamp and on the corresponding design of the container 2, it may also be provided that the downwards-projecting rim 17 of the attachment 5 overlaps the walls 16 of the container 2 across the entire circumference, whereas, in the exemplary embodiments shown, such an overlapping is interrupted at four sites 18 where the attachment simply rests on the top rim of the container 2. In these regions 18, the walls 16 of the container are designed to be thinner because of indentations provided there, with these sites serving for fixing the container 2 in the hand-operated stamp.

The invention claimed is:

1. An ink-storage unit adapted to be mounted in a hand-operated pre-inked stamp, comprising:

a trough-shaped container containing an ink-storage body, said container having a first side which is open and which is adapted to receive a printing plate, and having a second side opposite to the first side, said second side having a refilling opening, for supplying stamping ink to the ink-storage body in a state when the container is mounted in a hand-operated pre-inked stamp, the ink-storage body being configured to deliver stamping ink to a printing plate when the printing plate is received in the open, first side of the container, wherein a filling aid frame is associated with the container, said frame being detachably fixable, or fixed, to the open first side of the container in a state with no printing plate received thereon, for supplying stamping ink to the ink-storage body before its mounting in a hand-operated pre-inked stamp.

2. The ink-storage unit according to claim 1, wherein the frame and the walls of the container have cooperating snap-on fixing elements.

3. The ink-storage unit according to claim 2, wherein the snap-on fixing elements are provided at sites opposing each other.

4. The ink-storage unit according to claim 3, wherein the container is rectangular in top view, and wherein the snap-on fixing elements are provided on longitudinal sides of the container and of the frame.

5. The ink-storage unit according to claim 1, wherein the frame overlaps outer surfaces of walls of the container on all sides.

6. The ink-storage unit according to claim 1, wherein the frame has a height and a base area, and the ink-storage body has a given filling capacity for stamping ink, and wherein the height of the frame is dimensioned relative to its base area according to the filling capacity of the ink-storage body.

7. The ink-storage unit according to claim 1, wherein the frame has a circumferentially extending flange projection which, in a state where the frame is fixed to the open first side of the container, adjoins the ink-storage body.

8. The ink-storage unit according to claim 1, wherein the container and the attachment frame are rectangular, oval, or circular, in top view.

9. The ink-storage unit according to claim 1, wherein a lid is provided which covers the open first side of the container after the frame has been removed.

* * * * *